US009748714B1

(12) United States Patent
DeVito

(10) Patent No.: US 9,748,714 B1
(45) Date of Patent: Aug. 29, 2017

(54) REINFORCED USB SOCKET

(71) Applicant: Vincent Paul DeVito, Watchung, NJ (US)

(72) Inventor: Vincent Paul DeVito, Watchung, NJ (US)

( * ) Notice: Subject to any disclaimer, the term of this patent is extended or adjusted under 35 U.S.C. 154(b) by 0 days.

(21) Appl. No.: 15/276,678

(22) Filed: Sep. 26, 2016

(51) Int. Cl.
*H01R 24/64* (2011.01)
*H01R 107/00* (2006.01)

(52) U.S. Cl.
CPC ..... *H01R 24/64* (2013.01); *H01R 2107/00* (2013.01)

(58) Field of Classification Search
CPC ..... H01R 24/60; H01R 13/502; H01R 24/64
See application file for complete search history.

(56) References Cited

U.S. PATENT DOCUMENTS 7,758,379 B2 * 7/2010 Chen ..... H01R 13/6485 439/607.11
2013/0164982 A1 * 6/2013 Zhang ..... H01R 13/6598 439/607.46
2014/0170906 A1 * 6/2014 Ho ..... H01R 13/44 439/676
2015/0111436 A1 * 4/2015 Zhang ..... H01R 13/405 439/676
2015/0171562 A1 * 6/2015 Gao ..... H01R 13/6582 439/345
2015/0207257 A1 * 7/2015 Dai ..... H01R 13/405 439/660
2015/0295362 A1 * 10/2015 Tziviskos ..... H01R 13/6581 439/607.01

* cited by examiner

*Primary Examiner* — Briggitte R Hammond
(74) *Attorney, Agent, or Firm* — Quickpatents, LLC; Kevin Prince

(57) ABSTRACT

The present device is an electrical connector to provide electrical communication between electrical devices. The electrical connector has a reinforced member to protect the electrical connector from external damaging forces. The electrical connector has a shell with a cavity defined by a back wall, four inner side walls and an open front side. The electrical connector has a dielectric tongue which has a plurality of electrical contacts projecting into the cavity. The reinforced member is a stiffener assembly which is fixed to the back wall and aligned with the tongue. The stiffener assembly includes an insulating sleeve and an internal rigid stiffener. The stiffener assembly is fixed with the tongue or as an alternative within the tongue. At least one of the contacts is reinforced with an additional layer of conductive material to provide further protection from damaging external forces when a plug is inserted into the electrical connector.

16 Claims, 3 Drawing Sheets

REINFORCED USB SOCKET

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to electrical connectors, and more particularly to reinforced electrical connectors.

DISCUSSION OF RELATED ART

Electrical connectors such as USB sockets are used in computers, mobile phones, automobile applications, and other electrical devices. The USB sockets are used for a wide array of functions to provide communication between devices. Communications between the devices is achieved by USB plugs connected to one or both device sockets.

Some of the types of communications are powering a device, transferring files to a device, and coupling an accessory to a device.

One of the main issues with the USB sockets is that they can become damaged when the USB plug is improperly inserted in the USB socket. During the insertion process too much external force may be applied to the USB plug or the USB plug may be inserted upside down. This can result in the USB socket being damaged which can be expensive to repair if not the device in question having to be replaced as well as delays in using the device until the USB socket is repaired. USB sockets can be damaged when a USB plug is inserted at a non-orthogonal angle. Forced insertion at an acute angle, especially in confined hard to access spaces such as in automobiles, can cause internal connector damage and ruin its functionality. In addition to significant repair delays, a damaged connector can be expensive to replace and in some cases may require an entire circuit board or electrical device to be replaced.

Therefore, there is a need for a device that that minimizes the probability a USB socket is damaged when a USB plug is inserted into the USB socket. The present invention accomplishes these objectives.

SUMMARY OF THE INVENTION

The present device is an electrical connector to provide electrical communication between electrical devices. The electrical connector has a reinforced member to protect the electrical connector from damaging forces. The electrical connector has a shell with a cavity defined by a back wall, four inner side walls and an open front side. The electrical connector has a dielectric tongue which has a plurality of electrical contacts projecting into the cavity.

The reinforced member is a stiffener assembly which is fixed to the back wall and aligned with the tongue. The stiffener assembly includes an insulating sleeve and an internal rigid stiffener. The stiffener assembly will protect the electrical connector from damaging forces when a plug is inserted into the electrical connector.

The stiffener assembly is fixed with the tongue or within the tongue.

At least one of the contacts is reinforced with an additional layer of conductive material to provide further protection from damaging forces when a plug is inserted into the electrical connector.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
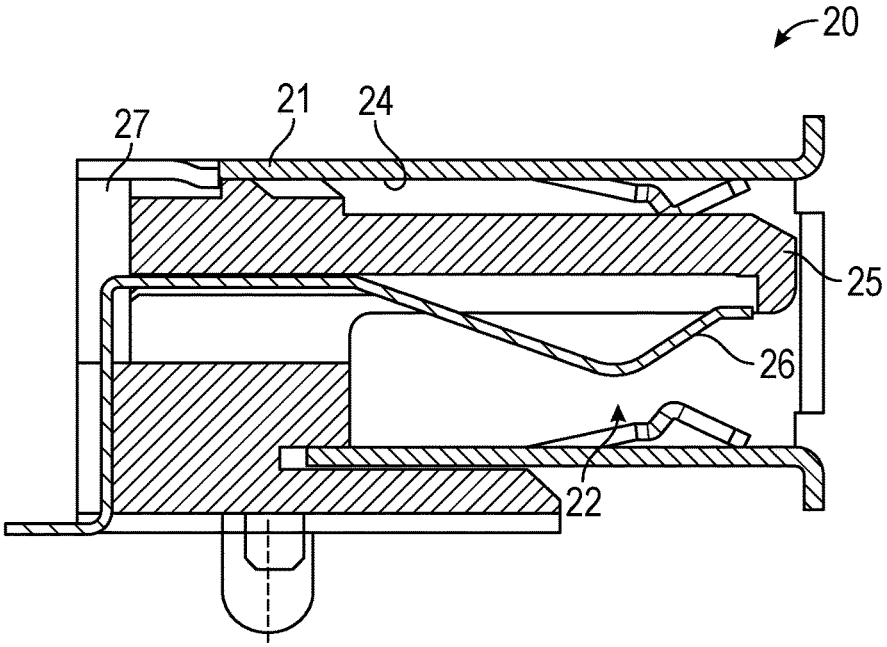
FIG. 1 (PRIOR ART)
FIG. 1 is a side view of the prior art.
Figure 2:
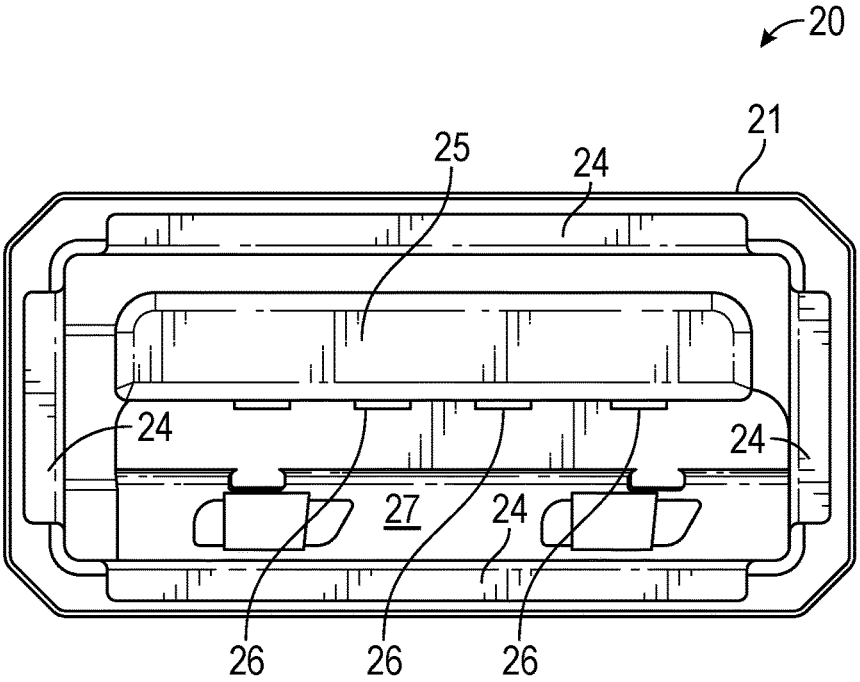
FIG. 2 (PRIOR ART)
FIG. 2 is a front view of the prior art.

FIGS. 1 and 2 show a conventional electrical connector 20 comprising a shell 21 with a cavity 22 defined by a back wall 27, four inner side walls 24, an open front side 23, and a dielectric tongue 25. The dielectric tongue 25 has a plurality of electrical contacts 26 projecting into the cavity from the back wall 27.

Figure 3:
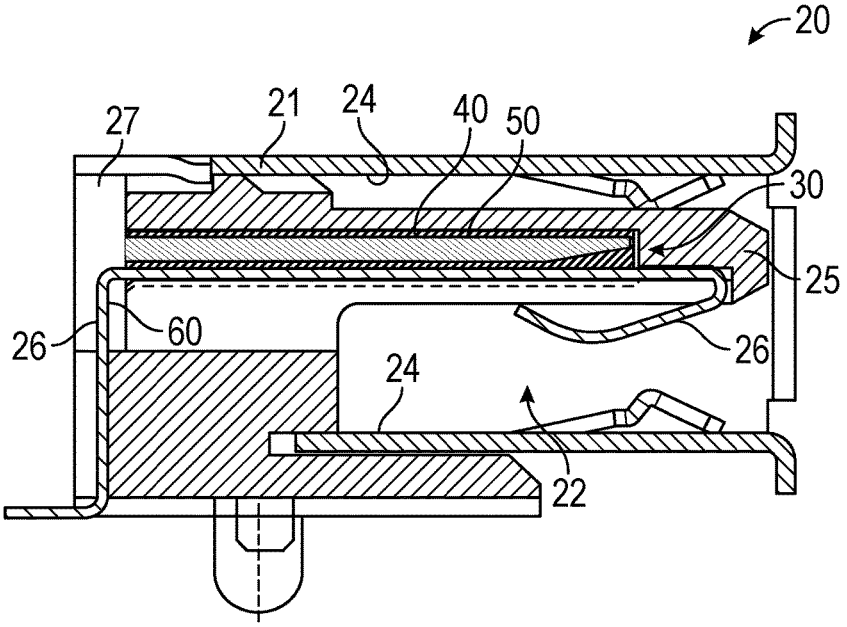
FIG. 3 is a side view of the invention.
Figure 4:
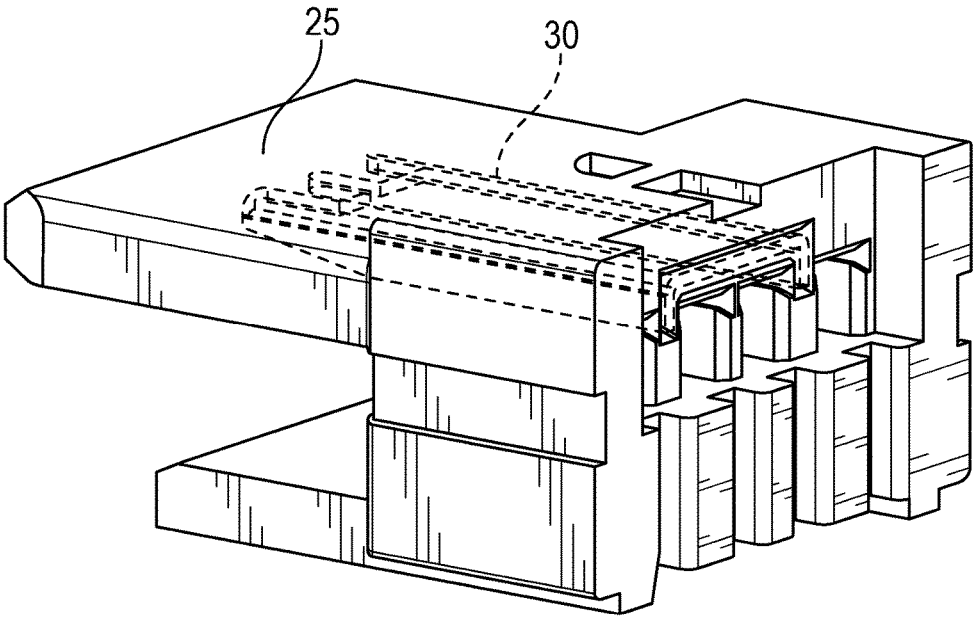
FIG. 4 is a partial rear perspective view of the invention.
Figure 5:
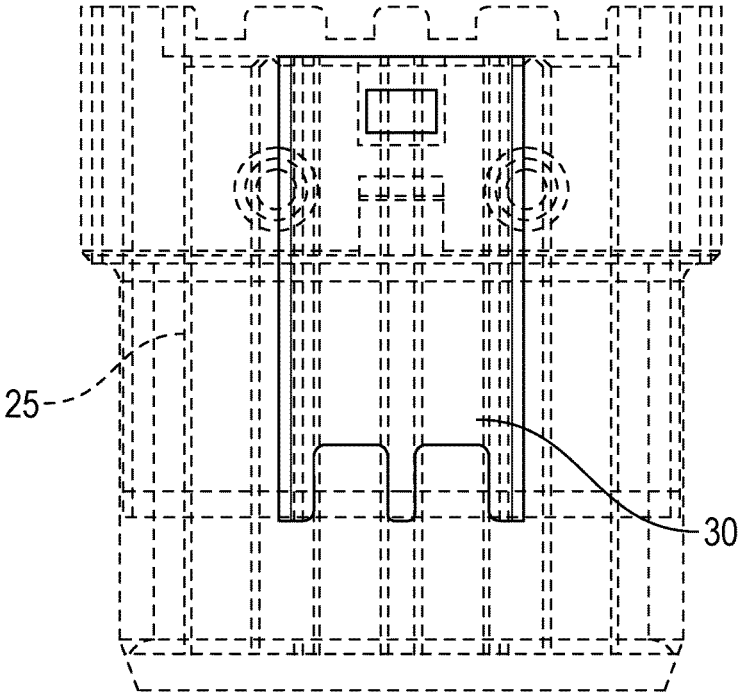
FIG. 5 is a top plan view of the invention, showing a stiffener assembly within a dielectric tongue, the dielectric tongue shown as transparent for clarity of illustration.
Figure 6:
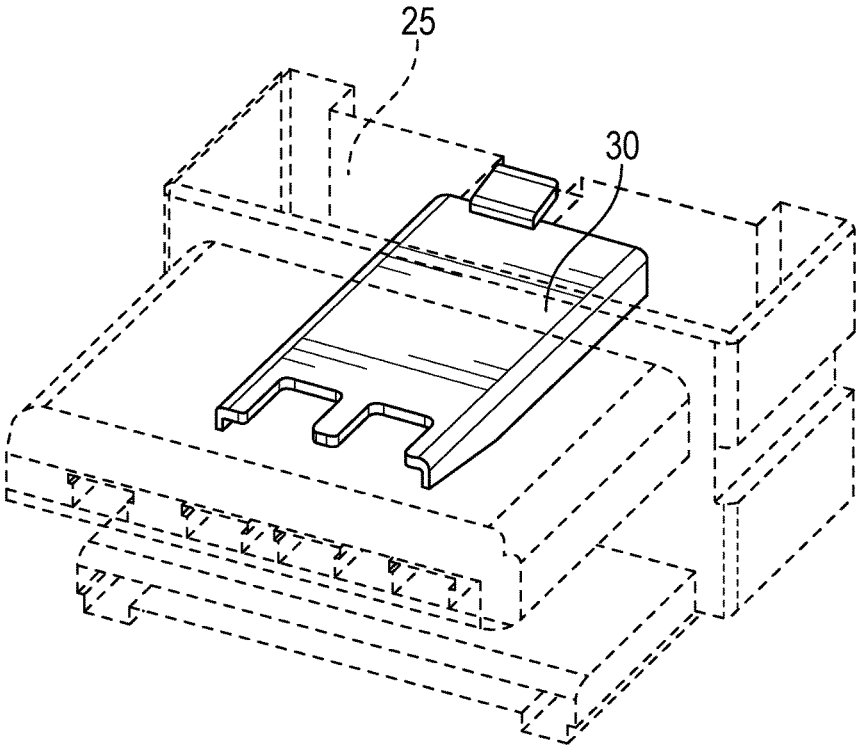
FIG. 6 is a perspective view of FIG. 5.

FIGS. 3-6 show an electrical connector 10 comprising a stiffener assembly 30 fixed with a back wall 27 and aligned with a dielectric tongue 25 and including an insulating sleeve 40 and an internal, rigid stiffener 50. Up and down or axial forces applied to the tongue 25 are inhibited by the stiffener assembly 30. FIG. 4 shows a dielectric insert with the shell 21 omitted for clarity.

The insulating sleeve 40 is made from a method and process including an injection-molded plastic material, rigid metal material, rigid plastic material and rigid epoxy resin material.

In FIG. 3 at least one of the electrical contacts 26 is reinforced with an additional layer 60 of a conductive metal material. The stiffener assembly 30 in FIG. 3 is fixed with the tongue 25. In an alternative embodiment the stiffener assembly 30 may be disposed within the tongue 25.

While a particular form of the invention has been illustrated and described, it will be apparent that various modifications can be made without departing from the spirit and scope of the invention. For example, the electrical connector could be for an HDMI or other type of electrical socket. Moreover, the electrical connector could be terminated on a circuit board in any conventional manner, such as with surface-mount leads or PCB mounted leads traversing the circuit board. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An improvement in an electrical connector of the type having a shell with a cavity that is defined by a back wall, four inner side walls and an open front side, a dielectric tongue having a plurality of electrical contacts projecting into the cavity from the back wall, the improvement comprising:

a stiffener assembly fixed with the back wall and aligned with the tongue and including an insulating sleeve and an internal, rigid stiffener;

whereby up-and-down or axial forces applied to the tongue are inhibited by the stiffener assembly.

2. The improvement of claim 1 wherein the insulating sleeve is made from an injection-molded plastic material.

3. The improvement of claim 1 wherein the stiffener is made from a rigid metal material.

4. The improvement of claim 1 wherein the stiffener is made from a rigid plastic material.

5. The improvement of claim 1 wherein the stiffener is made from a rigid epoxy resin material.

6. The improvement of claim 1 wherein at least one of the contacts is reinforced with an additional layer of a conductive metal material.

7. The improvement of claim 1 wherein the stiffener assembly is further fixed with the tongue.

8. The improvement of claim 1 wherein the stiffener assembly is disposed within the tongue.

9. An electrical connector comprising:

a shell having a cavity that is defined by a back wall, four inner side walls and an open front side;

a dielectric tongue having a plurality of electrical contacts projecting into the cavity from the back wall;

a stiffener assembly fixed with the back wall and aligned with the tongue and including an insulating sleeve and an internal, rigid stiffener;

whereby up-and-down or axial forces applied to the tongue are inhibited by the stiffener assembly.

10. The electrical connector of claim 9 wherein the insulating sleeve is made from a injection-molded plastic material.

11. The electrical connector of claim 9 wherein the stiffener is made from a rigid metal material.

12. The electrical connector of claim 9 wherein the stiffener is made from a rigid plastic material.

13. The electrical connector of claim 9 wherein the stiffener is made from a rigid epoxy resin material.

14. The electrical connector of claim 9 wherein at least one of the contacts is reinforced with an additional layer of a conductive metal material.

15. The electrical connector of claim 9 wherein the stiffener assembly is further fixed with the tongue.

16. The electrical connector of claim 9 wherein the stiffener assembly is disposed within the tongue.

* * * * *